United States Patent [19]

Panu

[11] 4,032,837

[45] June 28, 1977

[54] CURRENT TRANSFORMER

[75] Inventor: Kalevi Panu, Vaasa, Finland

[73] Assignee: Oy Stromberg AB, Helsinki, Finland

[22] Filed: Feb. 10, 1976

[21] Appl. No.: 656,967

[30] Foreign Application Priority Data

Feb. 18, 1975 Finland ..... 750445

[52] U.S. Cl. ..... 323/6; 336/83; 336/173; 336/178

[51] Int. Cl.[2] ..... H01F 40/06

[58] Field of Search ..... 323/6; 336/83, 173, 336/174, 175, 178, 212

[56] References Cited

UNITED STATES PATENTS 3,792,396 2/1974 Panu ..... 336/178 X

*Primary Examiner*—Thomas J. Kozma
*Attorney, Agent, or Firm*—Young & Thompson

[57] ABSTRACT

A current transformer comprising a tubular main insulator, a number of first windings arranged around the main insulator, and a number of second windings arranged inside the main insulator. The second windings are arranged opposite their corresponding first windings so that the pairs of windings formed in this way are, in the direction of the axis of the main insulator, at a distance from each other. The primary windings are connected in series. A magnetic circuit related to each pair of windings consists of a first core portion that surrounds each first winding from the outside and has yoke portions, and of a second core portion covering each second winding and the main insulator from the inside and has likewise yoke portions. The subsequent cores, or core portions, have common intermediate yoke portions and the primary windings are arranged so as to magnetize both cores in the same direction.

4 Claims, 3 Drawing Figures

CURRENT TRANSFORMER

The subject of the present invention is a current transformer comprising:

a tubular main insulator, at least two first windings (either primary or secondary windings arranged around the main insulator, at least two second windings (either secondary or primary windings) arranged inside the main insulator, preferably opposite corresponding first windings so that the pairs of windings formed in this way are, in the direction of the axis of the main insulator, at a distance from each other, whereby the primary windings are connected in series, and a magnetic circuit related to each pair of windings, comprising a first core portion that surrounds each first winding and the main insulator from the outside and has yoke portions, and a second portion covering each second winding and the main insulator from the inside and has yoke portions.

A current transformer of this type can be constructed, for example, by means of the technique suggested in the Finnish Pat. No. 46,571, according to which it is possible to place several separate cores on the same main insulator tube one after the other, as is shown in FIG. 1. In order to reduce the mutual effect of the cores, it is possible to leave a long air gap between the cores or to place an electrically highly conductive eddy-current plate (Al- or Cu-plate) between the cores. Such an arrangement requires relatively much space and material.

The object of the present invention is to eliminate the above drawbacks and, at the same time, to increase the precision of the cores.

A current transformer in accordance with the invention is mainly characterized in that subsequent cores (core portions) have common intermediate yoke portions and that the primary windings are arranged so as to magnetize both cores in the same direction.

Particular embodiments of the current transformer in accordance with the invention are defined in claims 1 to 4.

The invention will be examined more closely below with the aid of the embodiment in accordance with the attached drawing.

Figure 2:
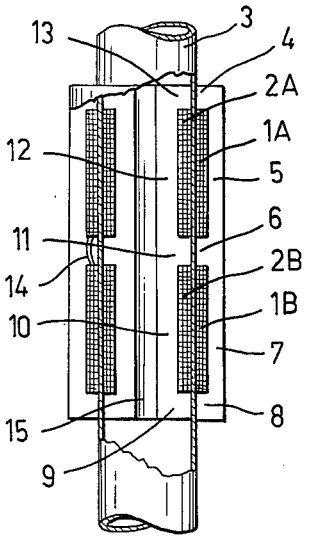
FIG. 2 shows an embodiment of the current transformer in accordance with the present invention, likewise as an axial section.
Figure 3:
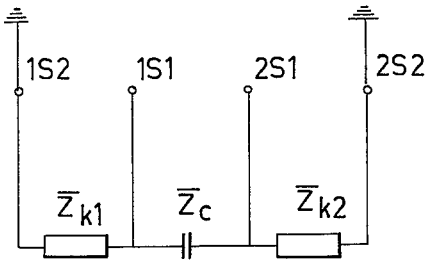
FIG. 3 shows the principal wiring diagram of the secondary side of the current transformer of FIG. 2.

As comes out from FIG. 2, the current transformer in accordance with the invention comprises a main insulator tube 3 of the shape of a hollow cylindrical tube, which is coaxially surrounded by primary windings 1A and 1B. These primary windings 1A and 1B are, on the other hand, surrounded on the outside by an outer core portion 4 to 8, which together with its yokes 4, 6 and 8 is shaped as an object mainly of the shape of a hollow cylindrical tube into which annular inside recesses have been made for said primary windings 1A and 1B.

On the other hand, inside the main insulator tube 3, an interior core portion 9 to 13 is placed coaxially, which core portion, together with its yokes 9, 11, 13, forms a structure in principle of the shape of a reel, through which an axial channel 15 passes. This cylindrical channel 15 operates, for example, as a cooling channel. The inner yoke portions 9, 11, 13 of the structure in accordance with FIG. 2 match the inner surface of the main insulator tube 3. Into the two grooves in this structure, two secondary windings 2A and 2B have been placed, whose outer mantles match the inner surface of said main insulator tube 3.

Subsequent outer core portons 4 to 6 and 6 to 8 have a common intermediate yoke. Correspondingly, subsequent inner core portions 13, 12, 11 and 11, 10, 9 have a common intermediate yoke 11, which is placed opposite the first-mentioned intermediate yoke 6.

The primary windings 1A and 1B are at point 14 connected in series and magnetize both cores in the same direction. The secondary windings 2A and 2B are almost identical and either at their beginning or at their end galvanically connected together (for example by earthing, FIG. 2). A capacitor $Z_C$ is connected between their free ends, which capacitor is dimensioned so that it compensates the magnetic resistance of the intermediate yoke.

The capacitance of the capacitor $Z_C$ is calculated as follows:

$$C \approx \frac{1}{\omega^2 L_o}, \text{ wherein}$$

$$L_o = \frac{N_2^2 \mu_o A_1}{\delta_i}, \text{ wherein}$$

$N_2$ = number of rounds in the secondary winding $\mu_o$ = magnetic permeability of vacuum $A_i$ = effective cross-section area of intermediate yoke $\delta_i$ = length of air gap in the intermediate yoke.

Figure 1:
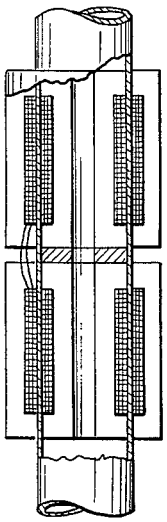
FIG. 1 shows a tube-insulated shell-core current transformer of a previously known type as an axial section.

When the current transformer operates, the fluxes of the cores run on the intermediate yoke 6, 11 against each other. The inner loads of the windings are identical as compared with each other so that the flux portions corresponding them annul each other. The differential flux resulting from the difference in the outer loads $\overline{Z}_{k1}$ and $\overline{Z}_{k2}$ (in FIG. 2) is compensated by the counter-magnetism caused by the capacitor $Z_C$. Thus, the magnetic voltage loss of the intermediate yoke is almost zero and the air-gap errors of the current transformer are only one half as compared with the case of FIG. 1. When the compensation is tuned correctly, a variation in the load of the adjoining core does not affect the errors, and consequently no mutual influence is present.

In the example case the axial dimensions of the primary winding 1A and 1B and of the secondary winding 2A and 2B are correspondingly equally large, and these windings are placed axially opposite each other. Likewise, the outer core portion 4 to 8 with its yokes 4, 6, 8 and the corresponding inner core portion 9 to 13 with its yokes 12, 11, 9 have equal respective axial dimensions and are axially placed opposite each other.

It should be mentioned that the core portions 4 to 8 and 9 to 13 are mainly intended to be manufactured by laying sheets radially. The inner core portions 10 and 12 can also be manufactured appropriately by winding out of foil tape, with insulating tape in between.

What I claim is:

1. A current transformer comprising:

a tubular main insulator, at least two first windings (either primary or secondary windings) arranged around the main insulator, at least two second windings (either secondary or primary windings) arranged inside the main insulator preferably opposite corresponding first windings so that the pairs of windings formed in this way are, in the direction of the axis of the main insulator, at a distance from each other, whereby the primary windings are connected in series, and a magnetic circuit related to each pair of windings, comprising a first core portion that surrounds each first winding and the main insulator from the outside and has yoke portions, and a second core portion covering each second winding and the main insulator from the inside and has yoke portions, wherein subsequent core portions have common intermediate yoke portions and the primary windings are arranged so as to magnetize both cores in the same direction.

2. A current transformer as claimed in claim 1, wherein the secondary windings are substantially identical.

3. A current transformer as claimed in claim 1, wherein the secondary windings are, at either corresponding end, galvanically connected together, said transformer further comprising a capacitor connected between the free ends of the secondary windings, which capacitor is dimensioned so as to compensate the magnetic resistace of the intermediate yoke.

4. A current transformer as claimed in claim 3, wherein the secondary windings are galvanically connected together by means of earthing.

* * * * *